US007397011B2

(12) United States Patent
Berdelle-Hilge

(10) Patent No.: US 7,397,011 B2
(45) Date of Patent: Jul. 8, 2008

(54) DEVICE FOR THE SORTING OF FLAT MAILINGS

(75) Inventor: Peter Berdelle-Hilge, Konstanz (DE)

(73) Assignee: Siemens Aktiengesellschaft, Munich (DE)

( * ) Notice: Subject to any disclaimer, the term of this patent is extended or adjusted under 35 U.S.C. 154(b) by 172 days.

(21) Appl. No.: 10/571,889

(22) PCT Filed: Sep. 7, 2004

(86) PCT No.: PCT/EP2004/009961

§ 371 (c)(1),
(2), (4) Date: Mar. 14, 2006

(87) PCT Pub. No.: WO2005/025765

PCT Pub. Date: Mar. 24, 2005

(65) Prior Publication Data

US 2007/0022719 A1 Feb. 1, 2007

(30) Foreign Application Priority Data

Sep. 15, 2003 (DE) ..... 103 42 463
Sep. 26, 2003 (DE) ..... 103 45 044

(51) Int. Cl.
*B07C 5/00* (2006.01)

(52) U.S. Cl. ..... 209/584; 209/900

(58) Field of Classification Search ..... 209/583, 209/584, 900, 912, 922, 923; 198/349, 370.01
See application file for complete search history.

(56) References Cited

U.S. PATENT DOCUMENTS

| | | | | |
|---|---|---|---|---|
| 4,008,813 | A | 2/1977 | Leersnijder | |
| 4,244,672 | A * | 1/1981 | Lund | 198/350 |
| 4,310,276 | A * | 1/1982 | Castagnoli | 198/367.1 |
| 6,246,023 | B1 | 6/2001 | Kugle | |
| 6,793,063 | B1 * | 9/2004 | Gillet et al. | 198/349 |
| 2003/0038065 | A1 | 2/2003 | Worth et al. | |

FOREIGN PATENT DOCUMENTS

| | | |
|---|---|---|
| DE | 690 10 841 | 5/1991 |
| EP | 0 638 501 | 2/1995 |
| EP | 0 708 693 | 5/1996 |
| EP | 0 820 818 | 1/1998 |
| EP | 1 093 862 | 4/2001 |
| EP | 1 258 297 | 11/2002 |

* cited by examiner

*Primary Examiner*—Joseph C Rodriguez

(57) ABSTRACT

A device for sorting flat mailings has a pouch loop system defining a transport path including a lower level and an upper level coupled via level transitions. The transport path has several partial loops including the level transitions and arranged within an inner area of the pouch loop system. The level transitions are positioned adjacent to one another within the inner area of the pouch loop system. The device includes further pouches and pouch loading stations coupled to the pouch loop system, wherein each partial loop includes at the lower level one of the pouch loading stations, and wherein the pouch loading stations are arranged adjacent to one another on the lower level. The pouches travel along the pouch loop system, wherein each pouch receives one flat mailing, and is configured for a controlled emptying corresponding to a read target address and a sorting plan.

3 Claims, 3 Drawing Sheets

DEVICE FOR THE SORTING OF FLAT MAILINGS

Figure 1:
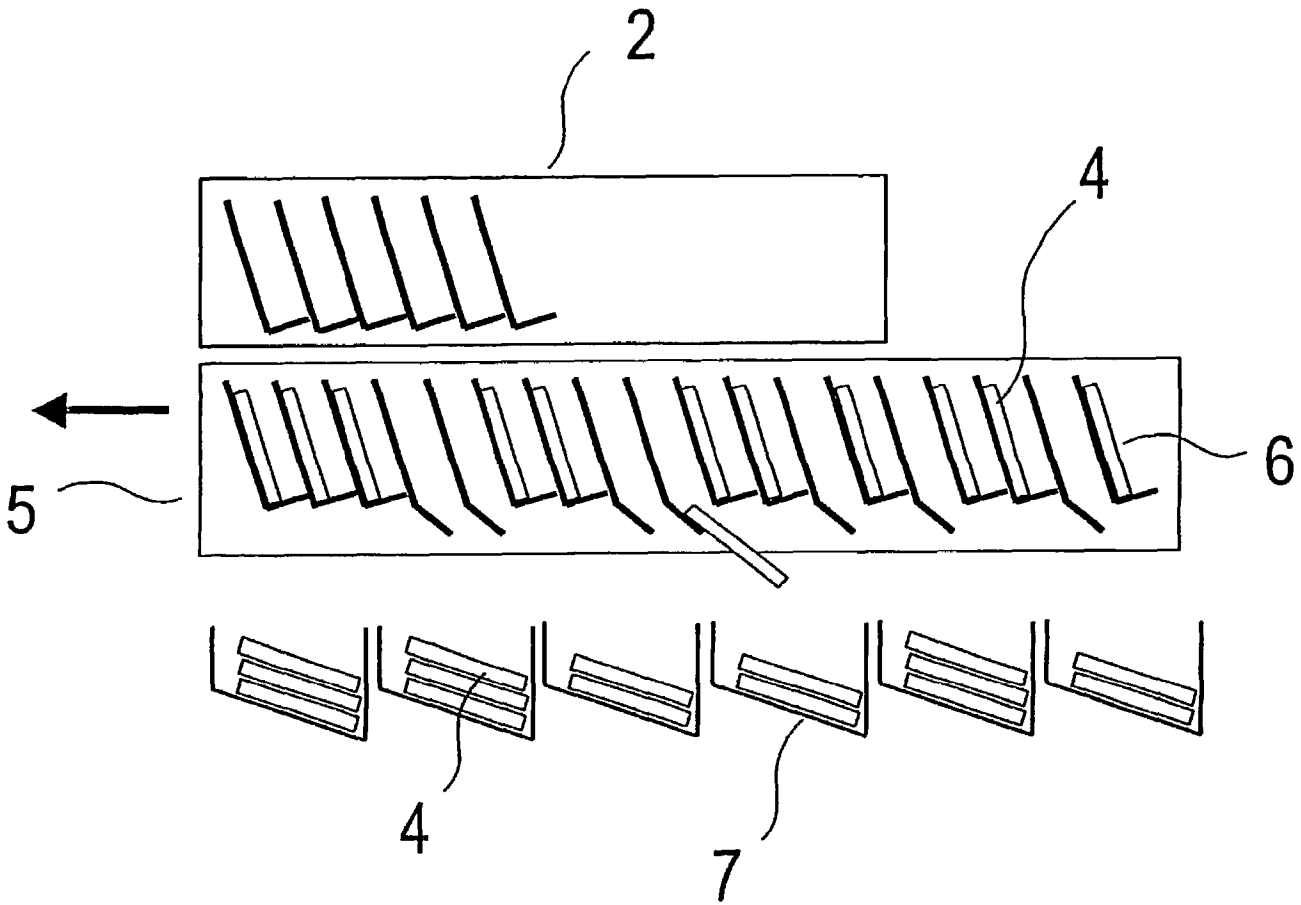

The invention relates to a device for the sorting of flat mailings, comprising pouches for individual mailings, circulating on a conveyor belt on two levels, the emptying of which may be controlled corresponding to the read target address and the sorting plan.

According to the prior art for sorting machines with circulating pouches (EP 0 708 693 B1, EP 0 820 818 A1), the mailings are loaded into the pouches at one position. The circulating pouches are opened as soon as the mailing has reached a predetermined end position. The pouches then move forward empty until they have reached the loading point, where they are once again loaded with a new mailing. Thus the pouches cover long distances empty, which reduces the throughput of the sorting machine. It would be more advantageous, therefore, to provide a loading point after each half circulation, for example, resulting in a reduction of the distances covered by the empty pouches. This is known per se when sorting parcels with tilting tray sorting machines but has not been used when sorting flat mailings, as loading the mailings at different points from a single feeder is too costly, or an operator would be necessary at each loading point (feeder area). Even with circulations on two levels, a loading point is only provided at one point (EP 0 708 693 B1).

In the abstract, EP-A-0 638 501 discloses a device for the sorting of flat mailings comprising pouches for individual mailings, circulating on a conveyor belt on two levels, the emptying of which may be controlled corresponding to the read target address and the sorting plan, whereby the total circulation in the pouch loop is carried out in several partial loops and whereby the level transitions for each partial loop are adjacent within the total circulation.

The object of the invention is to provide a device for sorting flat mailings with pouches circulating on a conveyor belt on two levels, with which either the throughput can be increased at the same circulating speed or, with the same throughput, either the circulating speed and/or the number of pouches can be reduced, without increased staff costs and with reduced additional equipment costs. In this connection, it is possible to carry out loading from a buffer with buffer pouches which circulate on one level.

The object is achieved according to the invention by the features of claim 1.

This particular layout of the conveyor belt allows a plurality of loading stations to be arranged adjacently on the lower level, although they feed into the circulation at a distance from one another around a circulation loop. This allows the loading stations and/or feeder areas to be operated with minimal use of operators.

Advantageous embodiments of the invention are shown in the sub-claims.

A buffer with circulating buffer pouches is advantageously provided between the two levels of the circulating pouches and which may be fed by one or more feeder stations with separating devices and subsequent reading devices and whose buffer pouches, which may be controllably emptied, transfer the mailings to the pouch loading stations. As a result, it is possible to feed in the mailings from one or more separating devices, independently from emptying the pouches for sorting.

It is moreover advantageous to provide unloading stations, for the additional removal of mailings, which are located before the pouch loading stations in the direction of transportation in the planar extension of the pouch loop, so that there is the possibility of further pouches being empty at the pouch loading stations.

Figure 2:
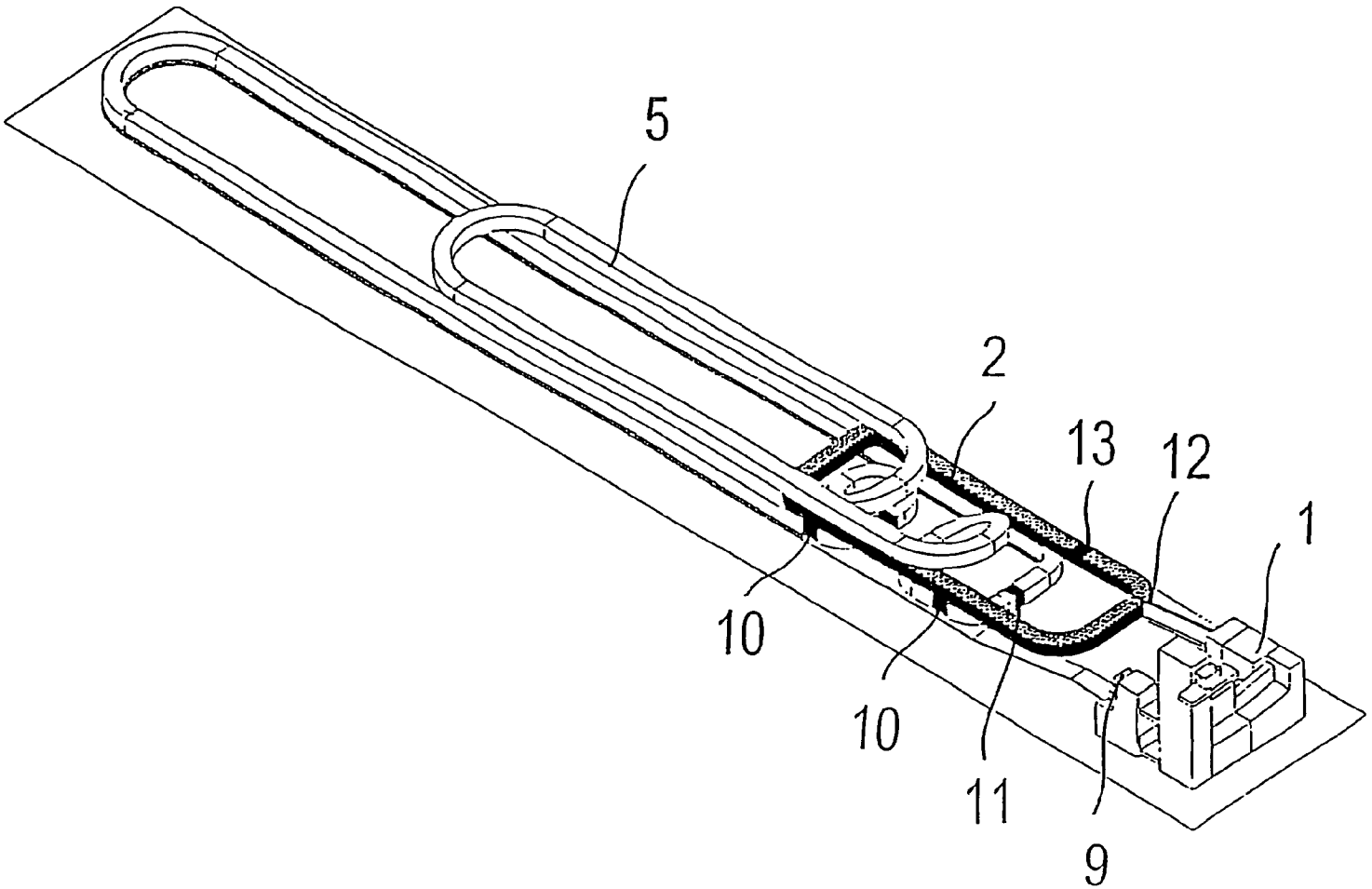
Figure 3:
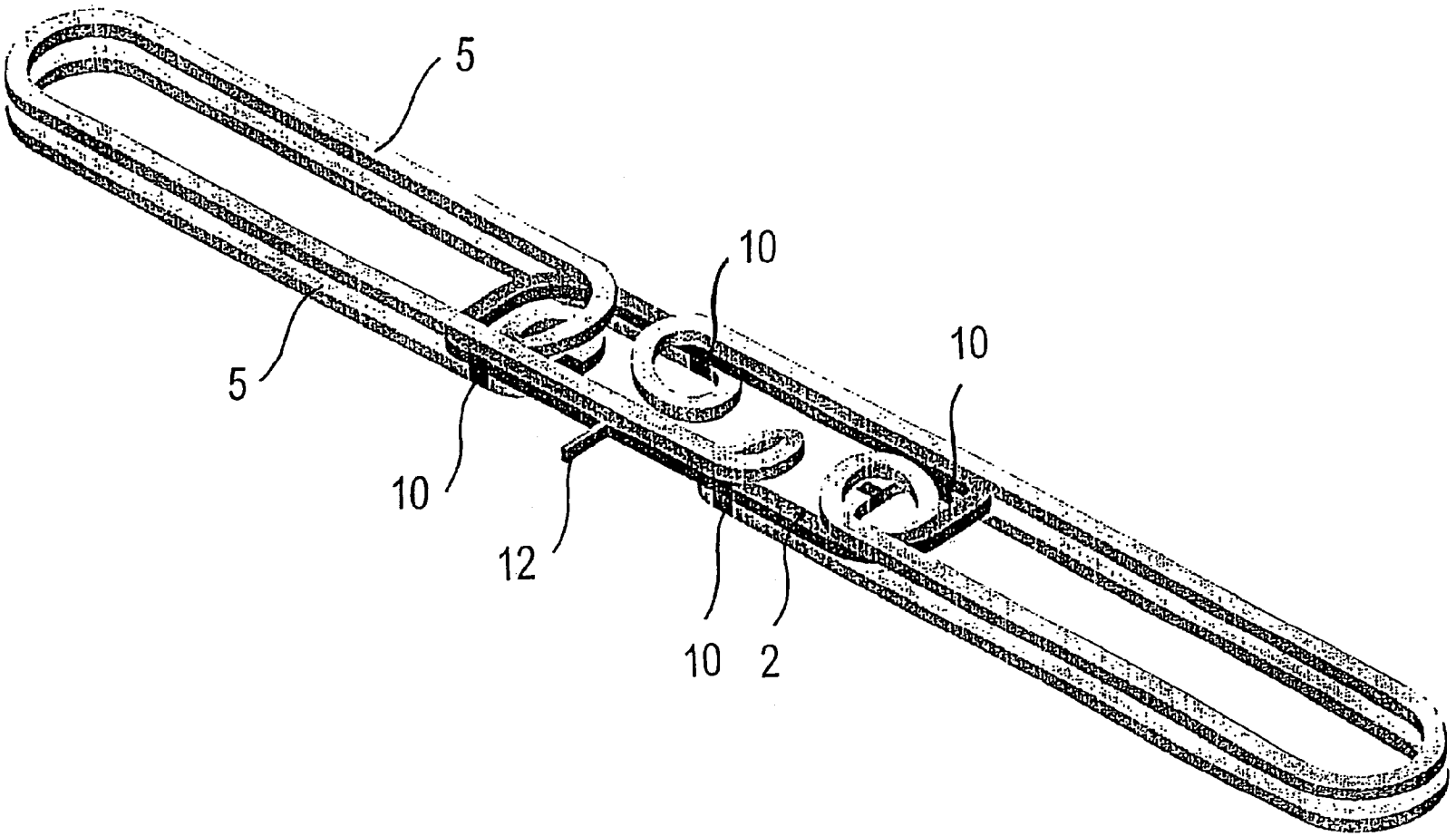

The invention is described in more detail hereinafter in an embodiment with reference to the drawings, in which:

FIG. 1 is a diagrammatic side view of a device for sorting according to the order of distribution, with the loading of a collector belt subdivided into sections, FIG. 2 is a perspective view of the sorting device with two levels and one bend, FIG. 3 is a perspective view of the sorting device with two levels and two bends.

In this example, the mailings are sorted in a plurality of end positions assigned to the target addresses which are arranged along the straight sections below the circulations.

The mailings 4 are firstly separated from a stack in the known manner in a separating device 1. The receiver addresses of the mailings 4 are then recorded and identified in a reading device, not shown. The read mailings 4 are then conveyed to a buffer device 2. At this point each mailing 4 is conveyed into a circulating buffer pouch 3 via a loading station, whereby these buffer pouches 3 may be controllably coupled to a circulating conveying means and may be controllably uncoupled from the conveying means and the transfer is carried out in the coupled state.

If, for throughput reasons, a plurality of separating devices 1 are provided, the mailings 4 are transported from each separating device 1 into the buffer pouches 3 via a separate loading station.

Due to the capacity of the buffer, it is possible to process further both an irregular incoming flow from the separating devices 1 and an outgoing flow which is not synchronized with the incoming flow and/or is irregular. The buffer pouches 3 can be controllably opened downwards in order to deposit the mailings 4 into empty pouches 6 of a further pouch loop 5 circulating below. In this connection, the pouches 6 are fixedly connected to the circulating conveying device. The pouch loop 5 and the buffer pouches 3 circulate in the same direction.

The mailings 4 are sorted according to the current sorting plan, with the mailings 4 falling downwards in a controlled manner into the sorting end positions 7 by opening the bottoms of the pouches 6.

In order to accommodate the sorting device on the smallest possible floor area, the pouch loop 5 passes through two levels. Parts of the pouch loop 5 are bent back over one another about horizontal axes: in principle, the pouch loop 5 has the path of horizontal figures of eight which have been bent where they cross and are surrounded at that point by the buffer device 2. The actuators for opening the pouches 6 of the pouch loop 5 can be fixedly arranged.

According to FIG. 2, two adjacent level transitions are respectively diverted by 540° over the interior of the installation. Visible outside the sorting end positions, not shown for reasons of clarity, are two adjacent pouch loading stations 10 with outlets of the buffer device 2 for loading the pouches 6 on the lower level, unloading stations 11 for additionally removing mailings 4 from the pouches 6 according to specific sorting criteria and which are arranged before the loading stations 10, so that there is the possibility of further pouches 6 being empty at the loading stations 10, a loading station 12 for loading the buffer pouches with the mailings from the separating device 1 and an outlet 13 of the buffer device 2 for removing mailings which have been separated off.

In FIG. 3 a sorting device is shown with two sets of bends. The diversions, together with the level transitions, are also arranged adjacent to one another inside the circulation, whereby the outer diversions are 540° due to the changeover to the other side and the inner diversions, where the mailings move forward on the same side, are 360°. In this connection, after respectively ¼ of the total circulation, a pouch loading station 10 is provided on the lower level, whereby the four loading stations are adjacent to one another (two on each side). In these examples the mailings circulate in the diversions in the same direction, which is not imperative, however.

The invention claimed is:

1. A device for sorting flat mailings, comprising:

a pouch loop system defining a transport path including a lower level and an upper level connected via level transitions, wherein the upper level of the transport path extends at least partially above and parallel to the lower level; wherein the transport path includes several partial loops comprising the level transitions and arranged within an inner area of the pouch loop system, wherein the level transitions are positioned adjacent to one another within the inner area of the pouch loop system;

pouch loading stations coupled to the pouch loop system, wherein each partial loop includes at the lower level one of the pouch loading stations, and wherein the pouch loading stations are arranged adjacent to one another on the lower level; and pouches configured to travel along the pouch loop system, wherein each pouch is configured to receive one flat mailing, and wherein the pouches are configured for a controlled emptying corresponding to a read target address and a sorting plan.

2. The device of claim 1, further comprising:

a buffer device arranged between the first level and the second level, wherein the buffer device comprises buffer pouches configured to circulate within the buffer device; and one or more feeder stations having separating devices and subsequent reading devices coupled to the buffer device to feed mailings to the one or more feeder stations, wherein the buffer pouches are configured to be emptied in a controlled manner to transfer the mailings to the pouch loading stations.

3. The device of claim 1, further comprising unloading stations configured to remove mailings and, with respect to a direction of transport, arranged in transport stations before the pouch loading stations in a planar extension of the pouch loading stations.

* * * * *